US005606810A

United States Patent [19]

Farrington et al.

[11] Patent Number: 5,606,810

[45] Date of Patent: Mar. 4, 1997

[54] WIRE SPACER FOR A SHAFT IN AN ELECTRICAL APPLIANCE

[75] Inventors: Richard I. Farrington, Seymour; George M. Drizos, Cheshire, both of Conn.

[73] Assignee: Black & Decker Inc., Newark, Del.

[21] Appl. No.: 587,318

[22] Filed: Jan. 16, 1996

[51] Int. Cl.[6] ..... D06F 75/26; H01H 3/10

[52] U.S. Cl. ..... 38/77.7; 219/252; 337/333

[58] Field of Search ..... 38/77.7, 77.83, 38/88; 219/251, 252, 253; 403/354, 357; 337/359, 333, 374, 375, 141

[56] References Cited

U.S. PATENT DOCUMENTS

| | | | |
|---|---|---|---|
| 2,235,893 | 3/1941 | Kuhn et al. | 219/256 X |
| 2,357,905 | 9/1944 | Olving | 219/252 X |
| 2,441,586 | 5/1948 | Morton | 38/77 |
| 2,548,016 | 1/1952 | Hild | 337/359 X |
| 2,814,711 | 11/1957 | Plint | 38/77.7 X |
| 2,993,286 | 7/1961 | Schreyer | 38/77.7 |
| 3,041,757 | 7/1962 | Swenson et al. | 38/77 |
| 3,352,998 | 11/1967 | Yai et al. | 219/252 |
| 4,109,136 | 8/1978 | Balchunas | 219/252 |
| 4,259,655 | 3/1981 | Balchunas | 337/361 |
| 4,345,389 | 8/1982 | Balchunas | 38/77.7 |

*Primary Examiner*—Ismael Izaguirre
*Attorney, Agent, or Firm*—Barry E. Deutsch

[57] ABSTRACT

An electrical steam iron having a soleplate, a housing, a thermostat and a temperature control knob connected to a shaft of the thermostat by an adapter. A spring is directly mounted to the adapter and has a deflectable portion between the adapter and the thermostat. The spring is a single wire that has a U-shaped center and crisscrossed L-shaped legs.

18 Claims, 3 Drawing Sheets

WIRE SPACER FOR A SHAFT IN AN ELECTRICAL APPLIANCE

BACKGROUND OF THE INVENTION

1. Field of the Invention

The present invention relates to electrical appliances and, more particularly, to a shaft and spring assembly used in an electrical appliance.

2. Prior Art

U.S. Pat. No. 4,109,136 discloses an iron having a rod with an offset position at its end that is mounted on a thermostat cap at an angle. U.S. Pat. No. 2,441,586 discloses a leaf spring that biases a lever and a cam downwardly. The stem of the thermostat passes through a hole in the spring. U.S. Pat. 3,041,757 discloses use of coiled springs around a valve stem in an iron.

SUMMARY OF THE INVENTION

In accordance with one embodiment of the present invention, in an electric steam iron having a soleplate, a housing, a thermostat, and a temperature control knob connected to a shaft of the thermostat by an adapter, the improvement comprises a spring directly mounted to the adapter. The spring has a deflectable portion between the adapter and the thermostat.

In accordance with another embodiment of the present invention, an electric steam iron is provided comprising a soleplate, a thermostat, a control, and a spring. The thermostat is mounted to the soleplate. The control is a user actuatable control that is connected to the thermostat by an adapter. The spring is directly mounted on the adapter and has a first section located between an end of the adapter and a portion of the thermostat.

In accordance with another embodiment of the present invention, a shaft and spring assembly for an electrical appliance is provided comprising a shaft and a spring. The shaft has an end with a keying aperture therein and an offset length that is offset from a center axis of the shaft. The spring is directly mounted to the shaft. The spring has a first deflectable section at the end of the shaft and a second section with two crisscrossed L-shaped portions mounted to the offset length.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
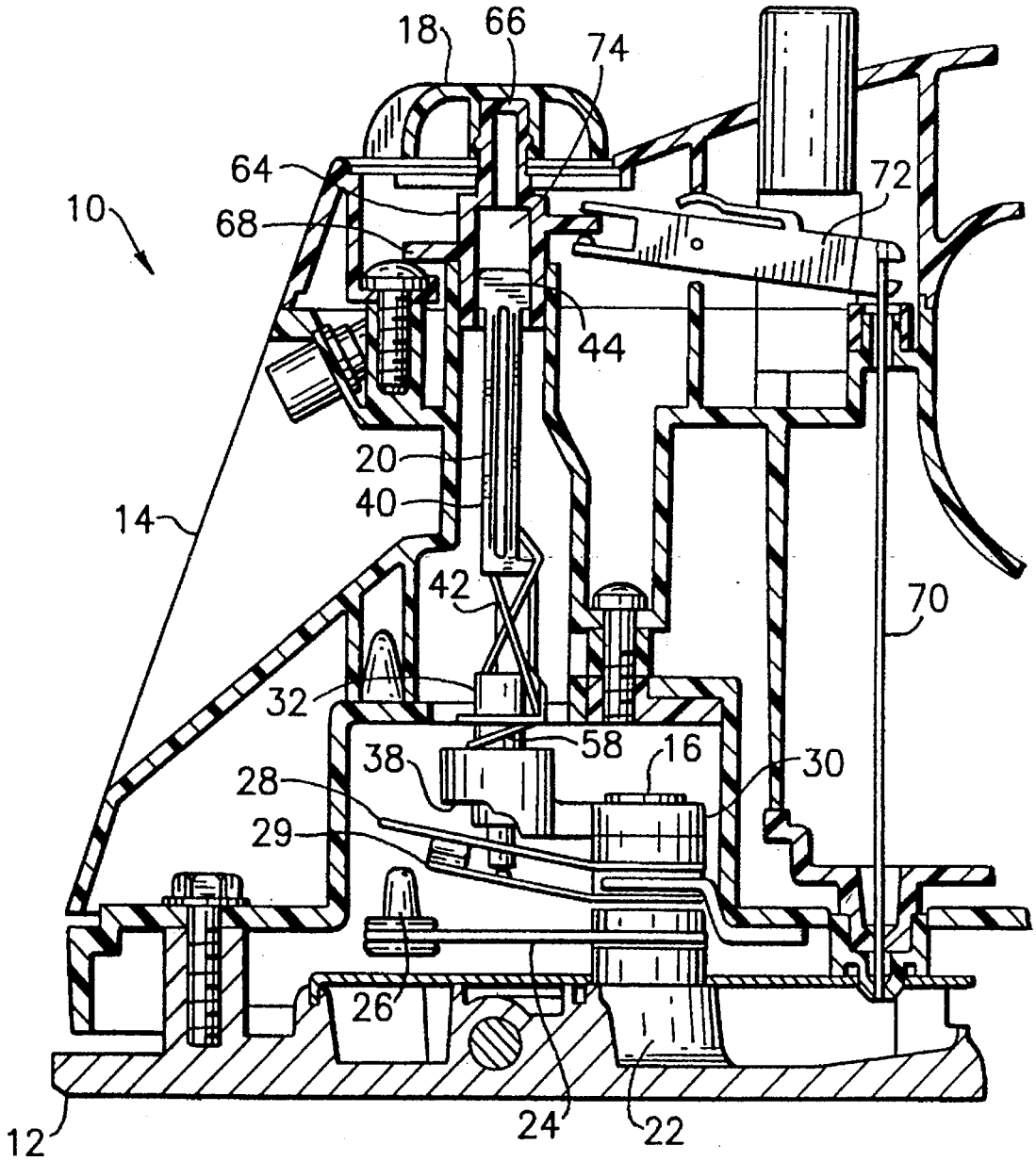
FIG. 1 is a cross-sectional view of the front of an electric steam iron incorporating features of the present invention.

Referring to FIG. 1, there is shown a cross-sectional view of the front of an electric steam iron 10 incorporating features of the present invention. Although the present invention will be described with reference to single embodiment shown in the drawings, it should be understood that features of the present invention can be embodied in many alternative forms of alternate embodiments. In addition, the shaft and spring assembly of the present invention can be used in any suitable type of electric iron or appliance. The various alternative embodiments may also have any suitable size, shape or type of elements or materials.

Figure 2:
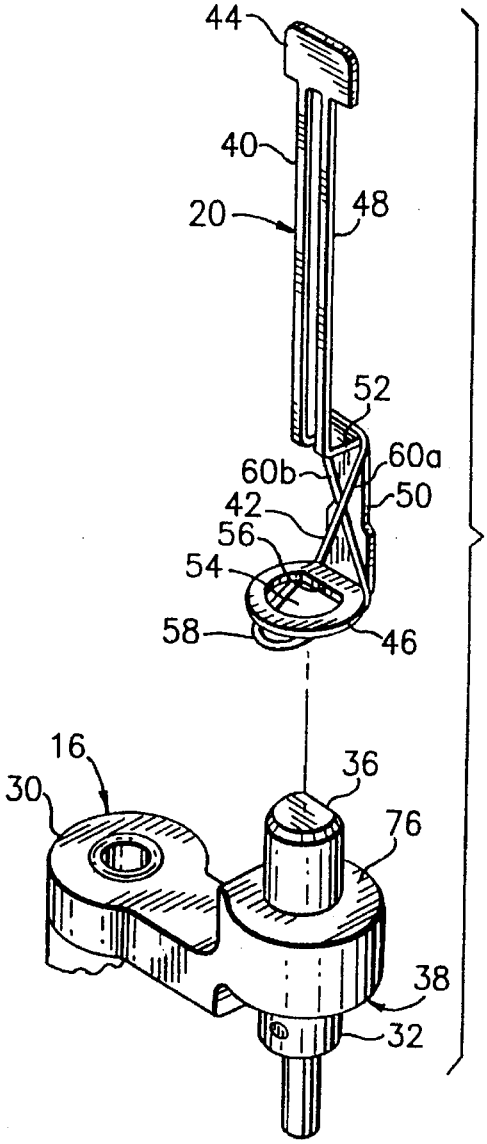
FIG. 2 is an exploded perspective view of the adapter shaft and spring assembly and the top of the thermostat shown in FIG. 1.
Figure 4:
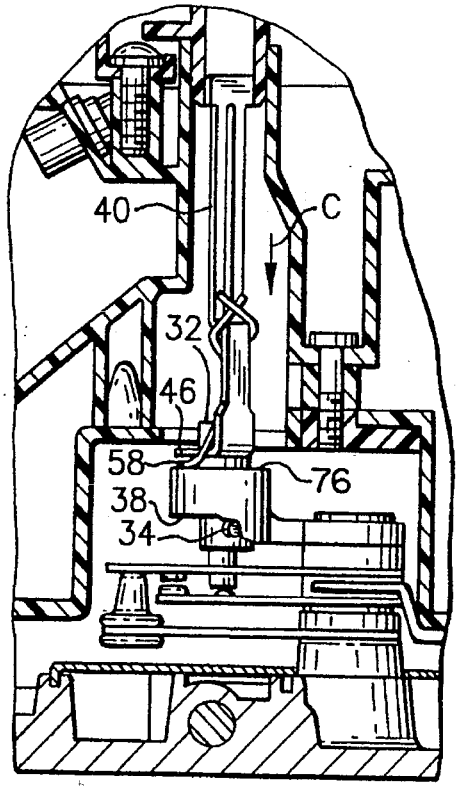
FIG. 4 is a partial cross sectional view of the front of the iron shown in FIG. 1 with the adapter shaft and spring assembly rotated to a second position.

The iron 10 generally comprises a soleplate 12, a housing 14, a thermostat 16, a temperature control knob 18, and an adapter shaft and spring assembly 20. The thermostat 16 is mounted to a boss 22 of the soleplate 12. The thermostat 16 is a flat stacked thermostat with a bi-metal blade 24, an insulated post 26, two electrical contact blades 28, 29, a frame 30, a shaft 32, and a cam member 34 (see FIG. 4). Referring also to FIG. 2, a side of the top of the shaft 32 has a flat surface 36 that is provided as an interlock key. The frame 30 has a cam surface 38. The cam member 34 is attached to the shaft 32 and rides along the cam surface 38 as the shaft 32 is axially rotated. The shaft 32 is biased in an upward direction by the lower contact blade 29. FIG. 1 shows the shaft 32 at an up position with the thermostat at a high temperature setting. FIG. 4 shows the shaft 32 at a down position with the thermostat at an OFF setting.

The cam member 34, cam surface 38 and lower contact blade 29 cooperate to move the shaft 32 up and down based upon axial rotation or position of the shaft 32.

In order to axially rotate the thermostat shaft 32 the adapter shaft and spring assembly 20 is connected to the top of the shaft 32. The assembly 20 has an adapter 40 and a spring 42. The adapter 40 is a one-piece flat deformed metal member that is cut and stamped to form the shaft as shown. The adapter 40 has a top end 44, a bottom end 46, a center shaft section 48 and an offset length section 50. A step 52 is provided to offset the offset section 50 from the center shaft section 48. The bottom end 46 extends from the bottom of the offset section 50 and includes an aperture 54. The aperture 54 matches the cross-sectional shape of the top of the thermostat shaft 32 with a flat section 56 to key the adapter with the shaft 32.

Figure 3A:
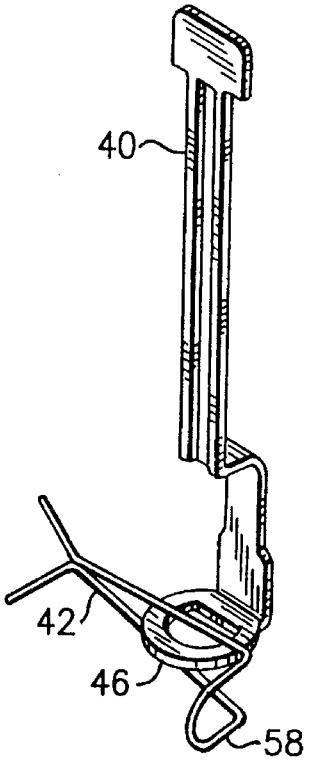
FIG. 3A is a perspective view of the adapter shaft shown in FIG. 2 and the spring at a first position during mounting of the spring to the adapter shaft.
Figure 3B:
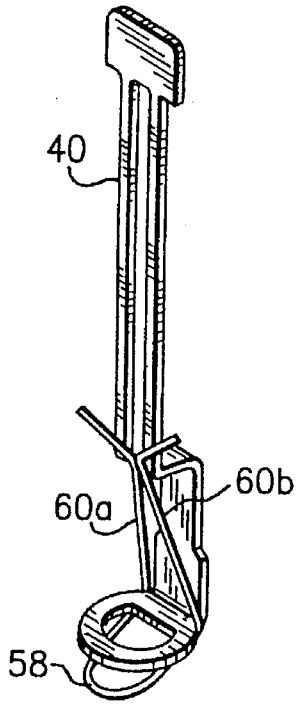
FIG. 3B is a perspective view of the adapter shaft as in FIG. 3A showing the spring at a second position during mounting of the spring to the adapter shaft.
Figure 3C:
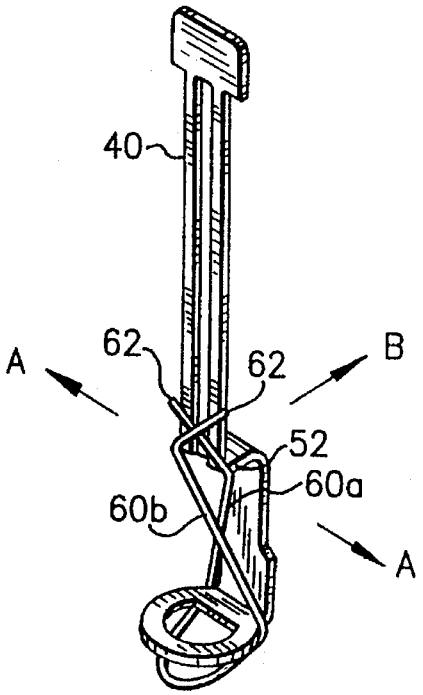
FIG. 3C is a perspective view of the adapter shaft as in FIG. 3B showing the spring at a third position during mounting of the spring to the adapter shaft.

The spring 42 is a one-piece wire member with a general U-shaped or looped middle section 58 and two L-shaped sections or legs 60*a*, 60*b*. The U-shaped section 58 is located below the bottom of the adapter 40. The U-shaped section 58 is angled relative to the flat bottom end 46 of the adapter. The two L-shaped sections 60*a*, 60*b* extend up along the inside surface of the offset section 50, crisscrossing each other, lapping over the step 52 and crisscrossing each other again above the step 52. This directly mounts the spring 42 to the adapter 40. Referring to FIGS. 3A–3C attachment of the spring 42 to the adapter will be described. The spring 42 is first slipped over the bottom end 46 as seen in FIG. 3A. The spring 42 is then rotated into place as shown by FIG. 3B. The L-shaped sections 60*a*, 60*b* are then moved in opposite directions as shown by arrows A in FIG. 3C. When the ends 62 of the sections 60*a*, 60*b* are sufficiently spaced from each other, they are moved in direction B until they are over the step 52 and released to form the assembly shown in FIG. 2. In alternate embodiments, the section of the spring located below the bottom end 46 of the adapter could have any suitable shape so long as it is deflectable. In addition, the upper legs of the spring could have any suitable shape to facilitate their connection to the adapter. The adapter could also have any suitable shape.

Referring to FIG. 1, the temperature control knob 18 is connected to the top end 44 of the adapter 40 by a steam valve cam member 64. The knob 18 is snap lock mounted to a top post 66 of the cam member 64. A cam rib 68 is connected to a steam valve stem 70 by a rocker 72. The cam member 64 has an aperture in its bottom forming an interior channel 74. The top end 44 of the adapter 40 is longitudinally slidably located in the channel 74. However, the top end 44 is rotationally interlocked with the member 64 such that when the member 64 is axially rotated, the adapter 40 is also axially rotated. The U-shaped section 58 of the spring 42 is located between the bottom end 46 of the adapter 40 and the top surface 76 (see FIG. 2) of the thermostat frame 30. The U-shaped section 58 partially surrounds the top of the thermostat shaft 32.

As noted above, FIG. 1 shows the thermostat at a high temperature position with the shaft 32 in an up position. The U-shaped section 58 of the spring biases the adapter 40 to a spaced distance from the top surface 76 of the thermostat frame 30. As the control knob 18 is rotated by a user to the OFF position shown in FIG. 4, frictional forces between the adapter 40 in the aperture 54 and the thermostat shaft 32 cause the adapter 40 to be pulled down with the shaft 32 as indicated by arrow C. The U-shaped section 58 is able to deflect between the bottom end 46 of the adapter 40 and the top surface 76 of the frame 30. However, after the shaft 32 reaches the OFF position shown in FIG. 4, the frictional forces between the shaft 32 and adapter 40 diminish and the U-shaped section 58 deflects back to its normal state moving the adapter 40, in a direction opposite to direction C, back to a raised position relative to the thermostat frame 30.

It is desirable to be able to turn the shaft 32 of the thermostat 16 without applying any downward force. Such downward force can adversely affect the temperature calibration of the thermostat. In the past, one type of design had an adapter ride up and down with the thermostat shaft. However, this caused the adverse effect on the temperature calibration of the thermostat from the downward force mentioned above. Another type of design had an adapter ride on the top surface of the thermostat frame. However, this caused binding problems because the thermostat shaft tries to move the adapter down with the shaft when the shaft is moved down. The present invention allows the shaft adapter and spring assembly 20 to rest on the top surface 76 of the frame 30, but also allows the adapter to move downward without binding problems. Thus, the present invention avoids both temperature calibration problems, by avoiding application of downward forces to the thermostat shaft, and prevents binding problems between the frame 30 and adapter 40.

The present invention directly attaches the spring 42 to the adapter 40 before they are mounted to the thermostat. This is done for an important reason. Although a separate coiled spring might be used instead of the spring 42, there is a risk that during assembly an assembler could accidentally drop such a separate spring into the skirt/soleplate assembly. A loose metal part, such as a coiled spring in the skirt/soleplate assembly is not desirable because it could cause an electrical short across electrical current carrying parts. The present invention, by directly mounting the spring 42 to the adapter 40, prevents the spring 42 from accidentally falling into the skirt/soleplate assembly.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In an electric steam iron having a soleplate, a housing, a thermostat, and a temperature control knob connected to a shaft of the thermostat by an adapter, wherein the improvement comprises:

a spring directly mounted to the adapter and having a deflectable portion between the adapter and the thermostat.

2. An iron as in claim 1 wherein the thermostat comprises a cam member connected to the shaft.

3. An iron as in claim 2 wherein the adapter has a keying aperture that has a keyed portion of the shaft located therein.

4. An iron as in claim 3 wherein the adapter has a flat bottom end with the aperture therein and a length of the adapter is offset from a center axis of the adapter and extends from the bottom end, the spring being mounted on the offset length.

5. An iron as in claim 4 wherein the spring comprises a single wire member.

6. An iron as in claim 5 wherein the deflectable portion of the spring has a loop located between a top plate of the thermostat and the bottom end of the adapter.

7. An iron as in claim 6 wherein the spring has two L-shaped sections extending from the loop that crisscross each other.

8. An iron as in claim 1 wherein, when the adapter is rotated to rotate the shaft in a first direction, the shaft pulls the adapter in a second direction with the spring being deflected between the adapter and the thermostat and, when the adapter is rotated to rotate the shaft in a third direction opposite to the first direction, the spring moves the adapter in a fourth direction opposite to the second direction.

9. An electrical steam iron comprising:

a soleplate;

a thermostat mounted to the soleplate;

a user actuatable control connected to the thermostat by an adapter; and a spring directly mounted on the adapter having a first section located between an end of the adapter and a portion of the thermostat.

10. An iron as in claim 9 wherein the end of the adapter has a keying aperture and a keyed portion of a shaft of the thermostat is located therein.

11. An iron as in claim 9 wherein a length of the adapter is offset from a center axis of the adapter, the spring being mounted on the offset length.

12. An iron as in claim 9 wherein the spring comprises a single wire member.

13. An iron as in claim 9 wherein the first section of the spring is a single U-shaped loop.

14. An iron as in claim 9 wherein the spring has two L-shaped sections extending from the first section that crisscross each other.

15. An iron as in claim 9 wherein, when the adapter is rotated to rotate a shaft of the thermostat in a first direction, the shaft pulls the adapter in a second direction with the first section of the spring being deflected between the adapter and the thermostat and, when the adapter is rotated to rotate the shaft in a third direction opposite to the first direction, the spring moves the adapter in a fourth direction opposite to the second direction.

16. A shaft and spring assembly for an electrical appliance, the assembly comprising:

a shaft having an end with a keying aperture therein and an offset length that is offset from a center axis of the shaft; and a spring directly mounted to the shaft, the spring having a first deflectable section at the end of the shaft and a second section with two crisscrossed L-shaped portions mounted to the offset length.

17. An assembly as in claim 16 wherein the spring is a single wire.

18. An assembly as in claim 17 wherein the first section comprised a generally U-shaped middle of the single wire.

* * * * *